US008732875B2

(12) United States Patent
O'Keefe

(10) Patent No.: US 8,732,875 B2
(45) **Date of Patent: *May 27, 2014**

(54) PATIENT SUPPORT APPARATUS WITH MOVABLE SIDERAIL ASSEMBLY

(71) Applicant: Hill-Rom Services, Inc., Batesville, IN (US)

(72) Inventor: Christopher R. O'Keefe, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/889,407

(22) Filed: May 8, 2013

(65) Prior Publication Data

US 2013/0312186 A1 Nov. 28, 2013

Related U.S. Application Data

(63) Continuation of application No. 12/938,804, filed on Nov. 3, 2010, now Pat. No. 8,453,283.

(51) Int. Cl.
*A47B 7/02* (2006.01)

(52) U.S. Cl.
USPC ..... 5/618; 5/613; 5/602; 5/428; 5/430; 5/624

(58) Field of Classification Search
USPC ..... 5/618, 613, 602, 428, 430, 624
See application file for complete search history.

(56) References Cited

U.S. PATENT DOCUMENTS

| | | | | |
|---|---|---|---|---|
| 4,105,242 | A | 8/1978 | Terbeek | |
| 4,119,342 | A | 10/1978 | Jones | |
| 4,632,450 | A | 12/1986 | Holdt | |
| 4,691,962 | A | 9/1987 | Holdt | |
| 4,795,214 | A | 1/1989 | Holdt | |
| 5,060,327 | A | 10/1991 | Celestina et al. | |
| D336,578 | S | 6/1993 | Celestina | |
| 5,333,887 | A | 8/1994 | Luther | |
| 5,659,910 | A | 8/1997 | Weiss | |
| 5,680,661 | A | 10/1997 | Foster et al. | |
| 5,715,548 | A | 2/1998 | Weismiller et al. | |
| 5,732,423 | A * | 3/1998 | Weismiller et al. | 5/425 |
| 5,842,237 | A | 12/1998 | Hargest et al. | |
| 6,009,570 | A | 1/2000 | Hargest et al. | |
| 6,089,593 | A | 7/2000 | Hanson et al. | |
| 6,154,899 | A | 12/2000 | Brooke et al. | |
| 6,163,903 | A | 12/2000 | Weismiller et al. | |
| 6,185,769 | B1 | 2/2001 | Larisey, Jr. et al. | |
| 6,212,714 | B1 | 4/2001 | Allen et al. | |
| 6,289,537 | B1 | 9/2001 | Hopper et al. | |
| 6,315,319 | B1 | 11/2001 | Hanson et al. | |
| 6,336,235 | B1 | 1/2002 | Ruehl | |
| 6,363,552 | B1 * | 4/2002 | Hornbach et al. | 5/425 |

(Continued)

*Primary Examiner* — Robert G Santos
*Assistant Examiner* — David E Sosnowski
(74) *Attorney, Agent, or Firm* — Barnes & Thornburg LLP

(57) ABSTRACT

A patient support apparatus includes a base, a frame coupled to the base, a deck supported by the frame and capable of moving relative to the frame, and a siderail assembly movable between a raised position above the deck and a first lowered position below the deck. The patient support apparatus further includes a siderail mover coupled to the deck to move the siderail assembly from the first lowered position to a second lowered position in response to movement of the deck relative to the frame.

19 Claims, 4 Drawing Sheets

(56) References Cited

U.S. PATENT DOCUMENTS

| | | | | |
|---|---|---|---|---|
| 6,374,436 | B1 | 4/2002 | Foster et al. | |
| 6,427,264 | B1 | 8/2002 | Metz et al. | |
| 6,470,520 | B1 | 10/2002 | Weismiller et al. | |
| 6,496,993 | B2 | 12/2002 | Allen et al. | |
| 6,565,112 | B2 | 5/2003 | Hanson et al. | |
| 6,684,427 | B2 | 2/2004 | Allen et al. | |
| 6,691,350 | B2 | 2/2004 | Weismiller | |
| 6,694,548 | B2 | 2/2004 | Foster et al. | |
| 6,704,954 | B2 | 3/2004 | Metz et al. | |
| 6,725,474 | B2 | 4/2004 | Foster et al. | |
| 6,726,279 | B1 | 4/2004 | Figel et al. | |
| 6,757,924 | B2 | 7/2004 | Goodwin et al. | |
| 6,817,363 | B2 | 11/2004 | Biondo et al. | |
| 6,846,042 | B2 | 1/2005 | Hanson et al. | |
| 6,948,202 | B2 | 9/2005 | Weismiller | |
| 6,978,499 | B2 | 12/2005 | Gallant et al. | |
| 7,000,272 | B2 | 2/2006 | Allen et al. | |
| 7,017,208 | B2 | 3/2006 | Weismiller et al. | |
| 7,107,636 | B2 | 9/2006 | Metz et al. | |
| 7,171,709 | B2 | 2/2007 | Weismiller | |
| 7,213,279 | B2 | 5/2007 | Weismiller et al. | |
| 7,216,384 | B2 | 5/2007 | Allen et al. | |
| 7,237,287 | B2 | 7/2007 | Weismiller et al. | |
| 7,243,386 | B2 | 7/2007 | Gallant et al. | |
| 7,325,265 | B2 | 2/2008 | Hornbach et al. | |
| 7,343,916 | B2 | 3/2008 | Biondo et al. | |
| 7,406,729 | B2 | 8/2008 | Hornbach et al. | |
| 7,458,119 | B2 | 12/2008 | Hornbach et al. | |
| 7,480,951 | B2 | 1/2009 | Weismiller et al. | |
| 7,512,998 | B2 | 4/2009 | Martin et al. | |
| 7,523,515 | B2 | 4/2009 | Allen et al. | |
| 7,568,246 | B2 | 8/2009 | Weismiller et al. | |
| 7,600,817 | B2 | 10/2009 | Kramer et al. | |
| 7,636,966 | B2 | 12/2009 | Gallant et al. | |
| 7,665,166 | B2 | 2/2010 | Martin et al. | |
| 7,676,862 | B2 | 3/2010 | Poulos et al. | |
| 7,690,059 | B2 | 4/2010 | Lemire et al. | |
| 7,730,562 | B2 | 6/2010 | Hornbach et al. | |
| 7,743,441 | B2 | 6/2010 | Poulos et al. | |
| 7,757,318 | B2 | 7/2010 | Poulos et al. | |
| 7,774,873 | B2 | 8/2010 | Martin et al. | |
| 7,779,494 | B2 | 8/2010 | Poulos et al. | |
| 7,784,128 | B2 | 8/2010 | Kramer | |
| 7,788,748 | B2 | 9/2010 | Wurdeman | |
| 7,805,784 | B2 | 10/2010 | Lemire et al. | |
| 7,861,334 | B2 | 1/2011 | Lemire et al. | |
| 8,056,160 | B2 | 11/2011 | Poulos et al. | |
| 8,069,514 | B2 | 12/2011 | Poulos et al. | |
| 8,266,742 | B2 | 9/2012 | Andrienko | |
| 8,453,283 | B2 * | 6/2013 | O'Keefe | 5/618 |
| 2008/0235872 | A1 | 10/2008 | Newkirk et al. | |
| 2010/0005592 | A1 * | 1/2010 | Poulos et al. | 5/618 |
| 2010/0223727 | A1 * | 9/2010 | Newkirk et al. | 5/602 |
| 2011/0208541 | A1 * | 8/2011 | Wilson et al. | 705/3 |
| 2012/0073054 | A1 * | 3/2012 | O'Keefe et al. | 5/618 |
| 2012/0102649 | A1 | 5/2012 | O'Keefe | |
| 2012/0144587 | A1 * | 6/2012 | Andrienko | 5/618 |

* cited by examiner

PATIENT SUPPORT APPARATUS WITH MOVABLE SIDERAIL ASSEMBLY

This application is a continuation of U.S. application Ser. No. 12/938,804, now U.S. Pat. No. 8,453,283, which was filed Nov. 3, 2010, and which is hereby incorporated by reference herein.

BACKGROUND

The present disclosure is related to a support apparatus for supporting a patient. More particularly, the present disclosure relates to a bed that can be manipulated to achieve both a conventional bed position having a horizontal support surface and a chair position having the feet of the patient on or adjacent to the floor and the head and back of the patient supported above a seat formed by the bed.

It is known to provide beds that have a head siderail assembly coupled to a head portion of the support surface and a foot siderail assembly coupled to a seat portion of the support surface. The siderail assemblies may be movable independently of one another between a raised position and a lowered position. When the bed is in the conventional bed position, the siderail assemblies may be used in the raised position to retain patients resting on the support surface and in the lowered position to transfer patients from the bed to another support apparatus, allow a caregiver improved access to the patient, or to help with entering and exiting the bed.

It is also known that when the bed is in the chair position, the siderail assemblies may be used in the raised position to retain patients resting on the support surface or to provide support to patients as they adjust themselves while resting on the support surface. It is also known that the foot siderails may be moved to the lowered position after the bed has moved to the chair position because the foot siderails otherwise may interfere with the movement of the bed to the chair position.

SUMMARY

The present application discloses one or more of the features recited in the appended claims and/or the following features which, alone or in any combination, may comprise patentable subject matter.

According to one aspect of the present disclosure, a patient support apparatus comprises a base, a frame, a deck, a siderail assembly, and a siderail mover. The frame is coupled to the base to move relative to the base. The deck is supported by the frame and is movable relative to the frame between a horizontal position and an articulated position. The deck includes a head section, a foot section spaced-apart from the head section, and a seat section positioned between the head and the foot sections. The seat section includes a foot edge, a head edge spaced-apart from and generally parallel to the foot edge, a first longitudinal edge extending between the foot and the head edges, and a second longitudinal edge spaced-apart from and generally parallel to the first longitudinal edge. The foot section is pivotable about a lateral pivot axis relative to the frame. The siderail assembly includes a linkage and a barrier. The linkage is coupled to the frame below the seat section and between the head and the foot sections. The barrier is coupled to the linkage to move relative to the deck between a raised position and a first lowered position. When the barrier is in the first lowered position, the barrier is positioned to lie between a first vertical plane defined by the first longitudinal side of the seat section and a second vertical plane defined by a longitudinal axis of the patient support apparatus. The siderail mover is configured to provide means for moving the siderail assembly from the first lowered position to a second lowered position in response to pivoting movement of the foot section about the lateral pivot axis in a first direction from a substantially horizontal position to a substantially vertical position so that the foot section of the deck does not cause damage to the siderail assembly as a result of the foot section moving to the substantially vertical position.

In some embodiments, the siderail mover includes a foot-section ramp. The foot-section ramp may be coupled to the foot section between a head edge of the foot section and a foot edge of the foot section. The foot-section ramp may include a foot-ramp surface. The foot-ramp surface may cooperate with the first plane to define a foot-ramp angle therebetween and the foot-ramp angle may be about 45 degrees.

In some embodiments, the siderail mover includes a siderail ramp. The siderail ramp may be coupled to the barrier. The siderail ramp may engage the foot-section ramp during movement of the siderail assembly from the first lowered position to the second lowered position. The siderail ramp may include a siderail-ramp surface. The siderail-ramp surface may cooperate with the first plane to define a siderail-ramp angle of about 45 degrees therebetween.

In some embodiments, the siderail mover is an actuator is coupled to the frame to move relative to the frame between a retracted position and an extended position. When the actuator is in the retracted position, the actuator may have a first length that may cause the siderail assembly to be in the first lowered position. When the actuator is in the extended position, the actuator may have a second length that may cause the siderail assembly to be in the second lowered position. The actuator may be electrically coupled to a bed controller that may be included in the patient support apparatus. The bed controller may cause the actuator to move from the retracted position to the extended position in response to movement of the foot section from the substantially horizontal position to the substantially vertical position.

In another aspect of the present disclosure, a patient support apparatus includes a base, a frame, a deck, and a siderail. The frame is coupled to the base to move relative to the base. The deck is supported by the frame. The deck includes a head section, a seat section, and a foot section. The head section is movable relative to the frame. The foot section is spaced-apart from the head section and is movable about a lateral pivot axis between a horizontal position and a vertical position. The foot section includes a top surface arranged to face in an upward direction and a bottom surface arranged to face in an opposite downward direction. The seat section is positioned between the head section and the foot section. The seat section includes a top surface arranged to face in the upward direction and a bottom surface arranged to face in the downward direction. The foot ramp is coupled to the bottom surface of the foot section to move therewith. The siderail assembly includes a linkage, a barrier, and a siderail ramp. The linkage is coupled to the frame. The barrier includes an inward side arranged to face toward the deck and an oppositely facing outward side. The barrier is coupled to the linkage to move relative to deck between a raised position and a lowered position. The barrier, when in the raised position, is substantially above the top surface of the seat section and defines a first support width. The barrier, when in the first lowered position, is positioned substantially below the bottom surface of the seat section and defines a second support width. The second support width may be smaller than the first support width. The siderail ramp is coupled the inward side of the barrier. The siderail assembly, when in the first lowered position, may cause the siderail ramp to cooperate with the foot ramp to move the siderail assembly in an outward direction away from the seat section of the deck a distance sufficient to permit continued rotation of the foot section in a first direction about the lateral pivot axis so that the foot section assumes the vertical position.

In some embodiments, the foot section includes a foot edge, a head edge, a first longitudinal edge, and a second longitudinal edge. The head may be spaced-apart from and generally parallel to the foot edge. The first longitudinal edge may extend between the head and the foot edges. The second longitudinal edge may be spaced-apart from and generally parallel to the first longitudinal edge. The top surface may extend between the foot, the head, the first longitudinal, and the second longitudinal edges. The bottom surface may be spaced-apart below and may extend between the foot, the head, the first longitudinal, and the second longitudinal edges. The foot ramp may extend along the first longitudinal edge between the head edge and the foot edge of the foot section.

The first longitudinal edge of the seat section may define a first vertical plane. The patient-support apparatus may include a longitudinal axis that may define a second vertical plane generally parallel to the first plane. The foot ramp may include a foot-ramp surface that may define a third plane. The third plane may intersect the first plane to define a first angle and a second angle. The first angle and the second angle may be complementary to one another. The first angle may be about 45 degrees.

The barrier may include an inward side, an outward side, a foot side, a head side, and siderail ramp. The inward side may be arranged to face toward the deck. The outward side may be arranged to face opposite the inward side. The foot side may be arranged to face toward a foot end of the patient-support apparatus. The head side may be spaced-apart from the foot side and may be arranged to face toward an opposite head end of the patient support apparatus. The top side may be arranged to extend between and to interconnect the head and the foot sides. The siderail ramp may be coupled to the inward side of the barrier and may be arranged to extend from the foot side toward and head side along the top side of the barrier.

The first longitudinal edge of the seat section may define a first plane. The longitudinal axis of the patient support apparatus may define a second vertical plane generally parallel to the first plane. The siderail ramp may include a siderail-ramp surface that defines a third plane. The third plane may intersect the first plane to define a first angle and a second angle. The first angle and the second angle may be complementary to one another and the first angle may be about 45 degrees.

In another aspect of the present disclosure, a patient support apparatus includes a base, a frame, a deck, a siderail assembly, and a siderail mover. The frame is coupled to the base to move relative to the base. The deck is supported by the frame and movable relative to the frame between a bed position and a chair-egress position. The deck includes a head section, a foot section, and a seat section. The head section is movable relative to the frame. The foot section is spaced-apart from the head section and is movable relative to the frame. The seat section is positioned between the head section and the foot section and is movable relative to the frame. The siderail assembly includes a linkage and a barrier. The linkage is coupled to the frame between the head and the foot sections of the deck. The barrier is coupled to the linkage to move relative to deck between a raised position and a first lowered position. When the barrier is in the first lowered position, the barrier is positioned to lie in a space defined to be below the deck and to be bounded by a perimeter of the deck when the deck is in the bed position. The siderail mover is coupled to the frame to move relative to the frame between a retracted position and an extended position. When the siderail mover is in the retracted position, the siderail mover has a first length that causes the siderail assembly to remain in the first lowered position. When the siderail mover is in the extended position, the siderail mover has a second length greater than the first length that causes the siderail assembly to move to a second lowered position in which the siderail assembly is below the deck and extends out of the space.

Additional features, which alone or in combination with any other feature(s), including those listed above, those listed in the claims, and those described in detail below, may comprise patentable subject matter. Other features will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIG. 4 is a sectional view taken along the line 4-4 of FIG. 3 with the foot section in a horizontal position and the foot siderail assembly in a first lowered position under a deck of the patient support apparatus;

FIG. 5 is a view similar to FIG. 4 with the foot section beginning to rotate downwardly and engaging the siderail assembly to move it outward towards a second lowered position as shown in FIGS. 2 and 6;

FIG. 6 is a view similar to FIG. 5 with the foot section continuing to rotate downwardly and maintaining the siderail assembly in the second lowered position;

DETAILED DESCRIPTION OF THE DRAWINGS

Figure 1:
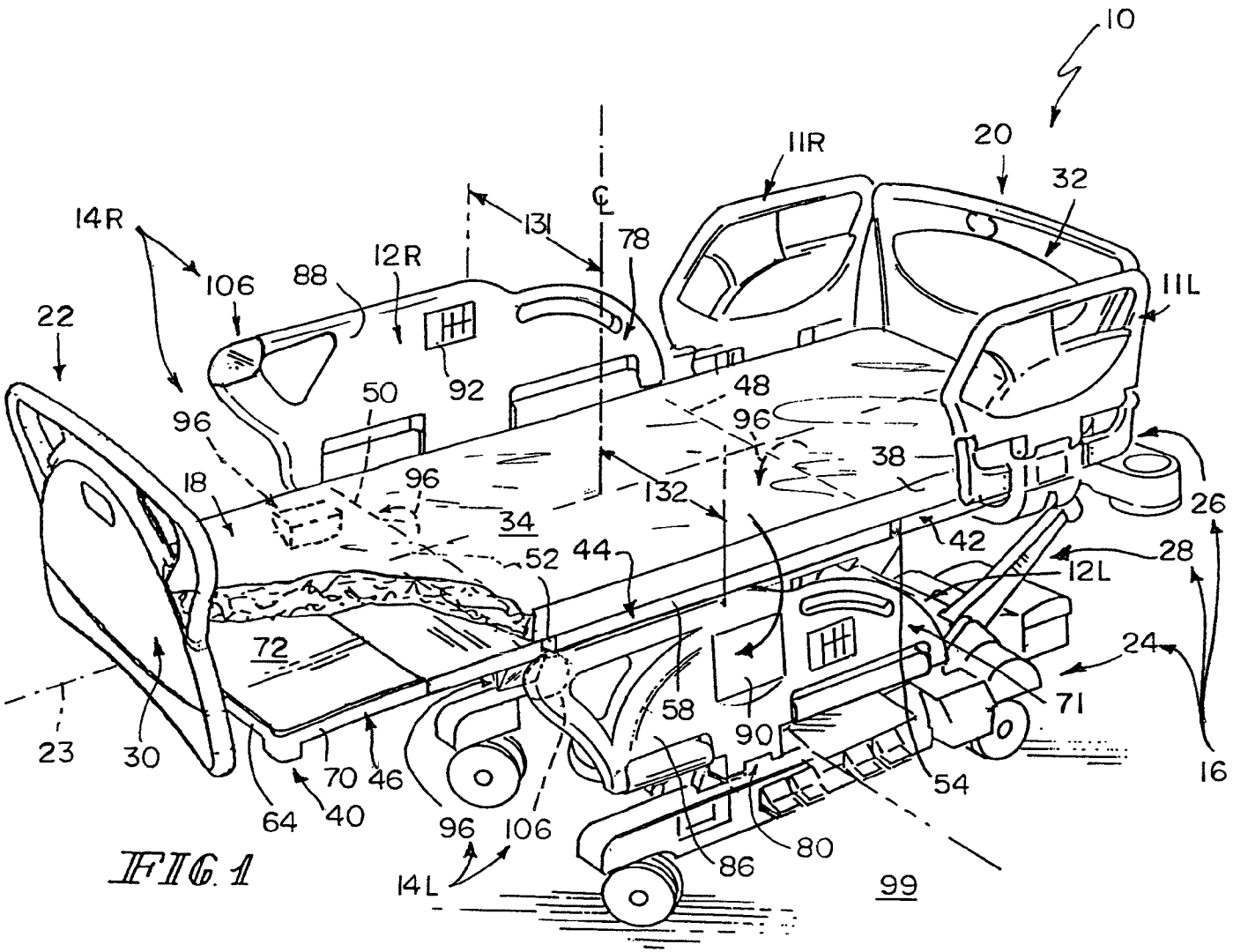
FIG. 1 is a perspective view of a patient support apparatus in a generally flat configuration with three siderail assemblies in a raised position and one siderail assembly in a first lowered position.
Figure 2:
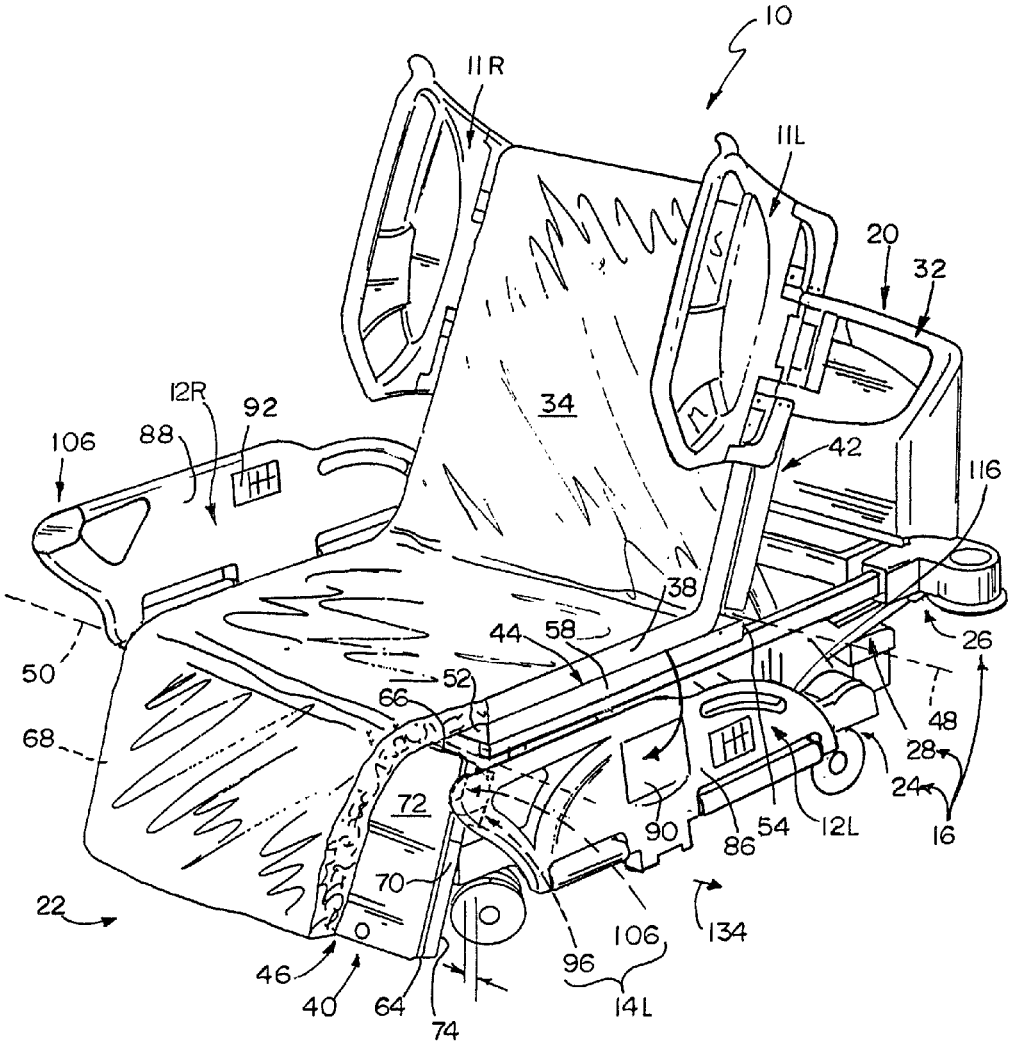
FIG. 2 is a perspective view of the patient support apparatus of FIG. 1 moved to a chair-egress position with one foot siderail assembly in the raised position and the other foot siderail assembly in a second lowered position.

A patient support apparatus, such as a hospital bed 10 is shown, for example, in FIGS. 1 and 2. The hospital bed 10 is movable between a bed position, as shown in FIG. 1, and a chair-egress position as shown in FIG. 2. The hospital bed 10, when in the bed position, provides support to a patient (not shown) such that the patient's feet are supported spaced-apart above the ground 99. The hospital bed 10, when in the chair-egress position, provides support to a patient such that the patient sits upright and the patient's feet are positioned on the ground 99. The hospital bed 10 also includes a patient-right foot siderail assembly 12R shown in a raised position in FIGS. 1 and 2 and a patient-left foot siderail assembly 12L shown in a first lowered position in FIG. 1. The foot siderail assemblies 12R, 12L are movable between the raised and the lowered positions whether the hospital bed 10 is in the bed position or the chair-egress position. A pair of siderail movers 14R, 14L are included in the hospital bed 10. The siderail movers 14R, 14L move the foot siderail assemblies 12R, 12L from the first lowered position of FIG. 1 to a second lowered position of FIG. 2 so that the hospital bed 10 may assume the chair-egress position without inferring with or damaging the foot siderail assemblies 12R, 12L.

The hospital bed 10 further includes a frame 16 and a mattress 18 that is supported by the frame 16 as shown in FIGS. 1 and 2. The hospital bed 10 has a head end 20 and a foot end 22 and a longitudinal axis 23 that extends therebetween. The frame 16 includes a base 24 and an upper frame 26 coupled to the base 24 by an elevation system 28. The elevation system 28 is operable to raise, lower, and tilt the upper frame 26 relative to the base 24. The hospital bed 10 further includes a foot panel 30 positioned adjacent the foot end 22 and a head panel 32 positioned adjacent the head end 20. The foot panel 30 is removable and is removed prior to moving the hospital bed 10 into the chair-egress position shown in FIG. 2.

The mattress 18 of the hospital bed 10 includes a top surface 34, a bottom surface 36, and a perimeter surface 38 as shown in FIGS. 1, 2, and 4-6. The upper frame 26 of the frame 16 supports a deck 40 with the mattress 18 supported on the deck 40. The deck 40, as shown in FIGS. 1 and 2, includes a head section 42, a seat section 44, and a foot section 46. The head section 42 moves about a first lateral pivot axis 48 relative to the upper frame 26. Additionally, the foot section 46 moves about a second lateral pivot axis 50 relative to the upper frame 26. Also, the foot section 46 is extendable and retractable to change an overall length of the foot section 46, and therefore, to change an overall length of the deck 40.

In some embodiments, the seat section 44 also moves, such as by translating on the upper frame 26, as the hospital bed 10 moves between the bed position and the chair-egress position. In those embodiments where the seat section 44 translates along the upper frame 26, the foot section 46 also translates along with the seat section 44. As the hospital bed 10 moves from the bed position to the chair-egress position, the foot section 46 lowers about the second lateral pivot axis 50 relative to the upper frame 26 and shortens in length. As the hospital bed 10 moves from the chair-egress position to the bed position, the foot section 46 raises relative to the seat section 44 and increases in length. Thus, in the chair-egress position, the head section 42 extends generally vertically upwardly from the upper frame 26 and the foot section 46 extends generally downwardly from the upper frame 26 as shown in FIG. 2.

The seat section 44 includes a foot edge 52, an opposite head edge 54, a first longitudinal edge 56, a second longitudinal edge 58, a top surface 60, and an opposite bottom surface 62 as shown in FIG. 2. The foot edge 52 is spaced-apart from and opposite the head edge 54. The first longitudinal edge 58 is spaced-apart from and opposite the second longitudinal edge 56. The first and second longitudinal edges 56, 58 extend between the head and the foot edges 52, 54. Together, all the edges 52, 54, 56, 58 cooperate together to define a perimeter of the seat section 44. The top surface 60 is arranged to face in an upward direction and extend between the four edges 52, 54, 56, 58 of the seat section 44. The bottom surface 62 is spaced-apart below the top surface 60, is arranged to face in an opposite downward direction, and extends between the four edges 52, 54, 56, 58 as suggested in FIG. 2. The first lateral pivot axis 48 is parallel to and between the head edge 54 and the head section 42.

The foot section 46 includes a foot edge 64, an opposite head edge 66, a first longitudinal edge 70, a second longitudinal edge 68, a top surface 72, and an opposite bottom surface 74 as suggested in FIG. 2. The foot edge 64 is spaced-apart from and opposite the head edge 66. The first longitudinal edge 70 is spaced-apart from and opposite the second longitudinal edge 68. The first and second longitudinal edges 68, 70 extend between the head and the foot edges 64, 66. Together, all the edges 64, 66, 68, 70 cooperate together to define a perimeter of the foot section 46. The top surface 72 is arranged to face in the upward direction when the hospital bed 10 is in the bed position and the top surface 72 extend between the four edges 64, 66, 68, 70 of the foot section 46. The bottom surface 74 is spaced-apart below the top surface 72, is arranged to face in the opposite downward direction when the hospital bed 10 is in the bed position, and extends between the four edges 64, 66, 68, 70 as suggested in FIG. 1. The second lateral pivot axis 50 is parallel to the first lateral pivot axis 48, the foot edge 52 of the seat section 44, and the head edge 66 of the foot section 46 as suggested in FIG. 1.

The hospital bed 10 also includes four siderail assemblies coupled to the upper frame 26: a patient-right head siderail assembly 11R, a patient-right foot siderail assembly 12R, the patient-left head siderail assembly 11L, and the patient-left foot siderail assembly 12L. Each of the siderail assemblies 11R, 12L, 12R, and 12L is movable between a raised position, as shown in FIGS. 1 and 2, a first lowered position shown in FIG. 1, and a second lowered position shown in FIG. 2. The siderail assemblies 11R, 11L, 12R, and 12L are sometimes referred to as siderails 11R, 11L, 12R, and 12L herein. As shown in FIG. 2, the patient-left foot siderail 12L is spaced-apart from and arranged to extend along the first longitudinal edge 58 of the seat section 44.

The left foot siderail 12L is similar to the other siderails 12R, 11R, and 12L, and thus, the following discussion of the left foot siderail 12L is equally applicable to other siderails 11R, 12R, and 11L. The siderail 12L includes a barrier panel 78 and a linkage 80 that is configured to guide the barrier panel 78 during movement of the foot siderail 12L between the raised and the lowered positions. The linkage 80 interconnects the barrier panel 78 and the upper frame 26 to cause the barrier panel 78 to remain in a substantially vertical orientation during movement between the raised and the lowered positions. As shown in FIG. 1, the hospital bed 10 has a first width 131 when the siderail assemblies 12L, 12R are in the raised position and the hospital bed 10 has a second width 132 when the siderail assemblies 12L, 12R are in the first lowered position. The first width 131 is less than the second width 132.

The barrier panel 78 includes an outward side 86 and an oppositely facing inward side 88. As shown in FIGS. 1 and 2, the inward side 88 faces toward the mattress 18 and the outward side 86 faces away from the mattress 18. A first user interface 90 is coupled to the outward side 86 of the barrier panel 78 for use by a caregiver (not shown). As shown in FIGS. 1 and 2, a second user interface 92 is coupled to the inward side 88 for use by a patient (not shown). Both the first and second user interfaces 90, 92 are coupled electrically to a bed controller 94 included in the hospital bed 10. The user interfaces 90, 92 allow caregivers and patients to control movement of the elevation system 28 as well as other features of the hospital bed 10.

The barrier panel 78 also includes a foot side 114, a head side 116, and a top side 118. The foot side 114 faces the foot end 22 of the hospital bed 10. The head side 116 faces toward the head end 20 of the hospital bed 10. The top side 118 extends between and interconnects the foot side 114 and the head side 116. The top side 118 also extends between the inward and the outward sides 86, 88 of the barrier panel 78.

As discussed previously, the hospital bed 10 also includes the pair of siderail movers 14R and 14L as shown in FIGS. 1 and 2. The patient-left siderail mover 14L is similar to the patient-right siderail mover 14R, and thus, the following discussion of the patient-left siderail mover 14L is equally applicable to the patient-right siderail mover 14R. The siderail mover 14L is configured to provide means for moving the barrier panel 78, also called barrier 78, from the first lowered position of FIG. 1 to a second lowered position of FIG. 2 in response to pivoting movement of the foot section 46 about the second lateral pivot axis 50 in a first direction 96 indicated by an arrow 96 from a substantially horizontal position associated with the hospital bed 10 being in the bed position to a substantially vertical position associated with the hospital bed 10 being in the chair-egress position. The siderail 12L moves to the second lowered position to permit the foot section 46 to move to the substantially vertical position without the foot section 46 interfering with or damaging the siderail 12L.

Figure 3:
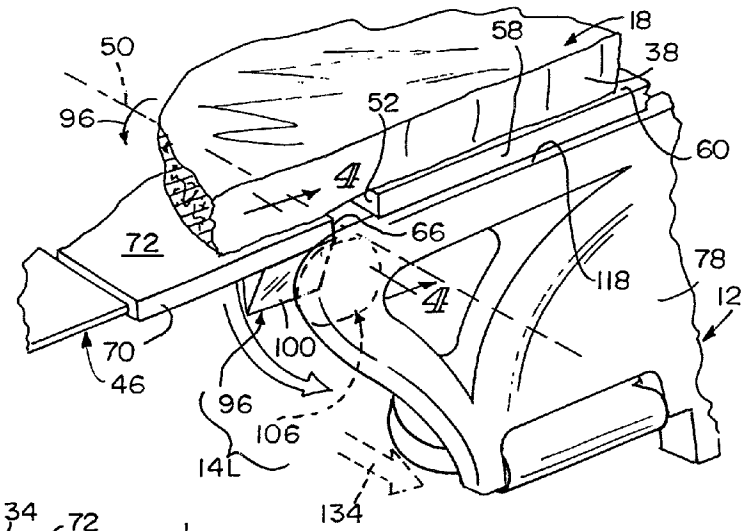
FIG. 3 is an enlarged partial perspective view of the patient support apparatus of FIG. 1 showing a siderail mover coupled to a foot section of the patient support apparatus.

As shown in FIG. 3, the siderail mover 14L includes a foot-section ramp 98 that is coupled to the foot section 46 to move therewith. The foot-section ramp 98 is coupled to the bottom surface 74 of the foot section 46 between the head edge 66 of the foot section 46 and the foot edge 64 of the foot section 46. As illustrated in FIG. 3, the foot-section ramp 98 is extends along the first longitudinal edge 70 of the foot section 46.

The foot-section ramp 98 includes foot-ramp surface 100 that extends away from the first longitudinal edge 70 toward the longitudinal axis 23 of the hospital bed 10. The first longitudinal edge 70 of the foot section also defines a first vertical plane 101 and the foot-section ramp 98 defines a foot-ramp plane 112, also called the third plane, that cooperates with first vertical plane 101 to define a foot-ramp angle 104 of about 45 degrees therebetween and a second angle 105 that is complementary with the foot-ramp angle 104 as shown in FIG. 4.

Figure 4:
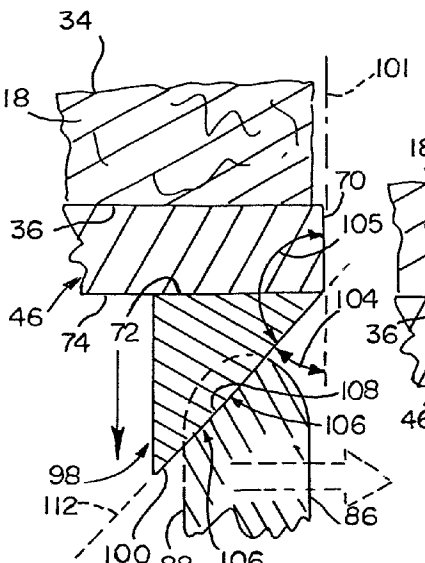
FIGS. 4-6 are a series of sectional views showing rotation of the foot section from a horizontal position to a vertical position.
Figure 5:
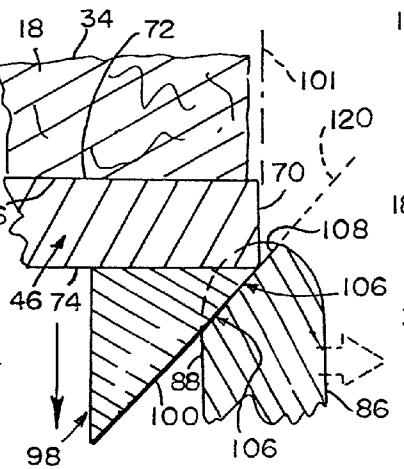
Figure 6:
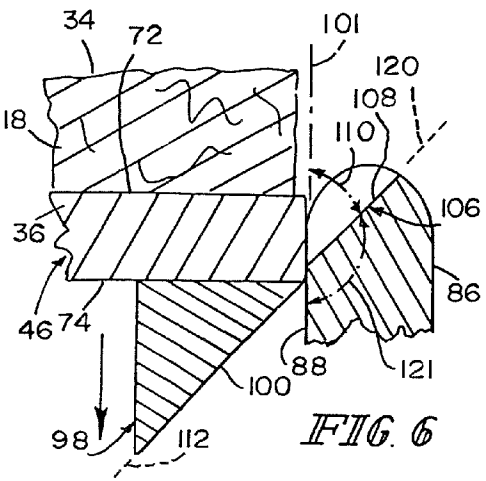

The siderail mover 14L also includes a siderail ramp 106 as shown in FIGS. 4-6. The siderail ramp 106 is coupled to the barrier panel 78 to move therewith. The siderail ramp 106 is also coupled to the inward side 88 of the barrier panel 78 and extends from the foot side 114 toward the head side 116 along the top side 118 of the barrier panel 78. The siderail ramp 106 engages the foot-section ramp 98 during movement of the foot section 46 from the substantially horizontal position of FIG. 1 to the substantially vertical position of FIG. 2 to cause the siderail 12L to move from the first lowered position of FIG. 1 to the second lowered position of FIG. 3.

The siderail ramp 106 includes a siderail-ramp surface 108 that extends away from the inward side 88 of the barrier panel 78 toward the outward side 86. The siderail-ramp surface 108 defines a siderail-ramp plane 120, also called a third plane, that cooperates with the first vertical plane 101 to define a siderail-ramp angle 110 of about 45 degrees therebetween and a second angle 121 that is complementary with the siderail-ramp angle 110 as shown in FIG. 6. As shown in FIGS. 4-6, the siderail-ramp surface 108 is generally parallel with the foot-ramp surface 100. The two surfaces 108, 100 are arranged to lie in confronting relation to one another as the siderail 12L moves from the first lowered position to the second lowered position.

In use, the siderail assemblies 12L, 12R are moved to the first lowered position while the hospital bed 10 is in bed position. As the hospital bed 10 moves to the chair-egress position, the foot section 46 engages the siderail assembly 12L and cause the siderail assembly 12L to move in an outward direction 134 away from the seat section 44 a distance 136 sufficient to permit continued rotation of the foot section 46 in a first direction 96 about the lateral pivot axis 50. As the siderail assemblies 12L, 12R move to the second lowered position, space is established for the foot section 46 to assume the substantially vertical position. The hospital bed 10 has a third width when the siderail assemblies 12L, 12R are in the second lowered position. The third width is greater than the first width 131.

Figure 7:
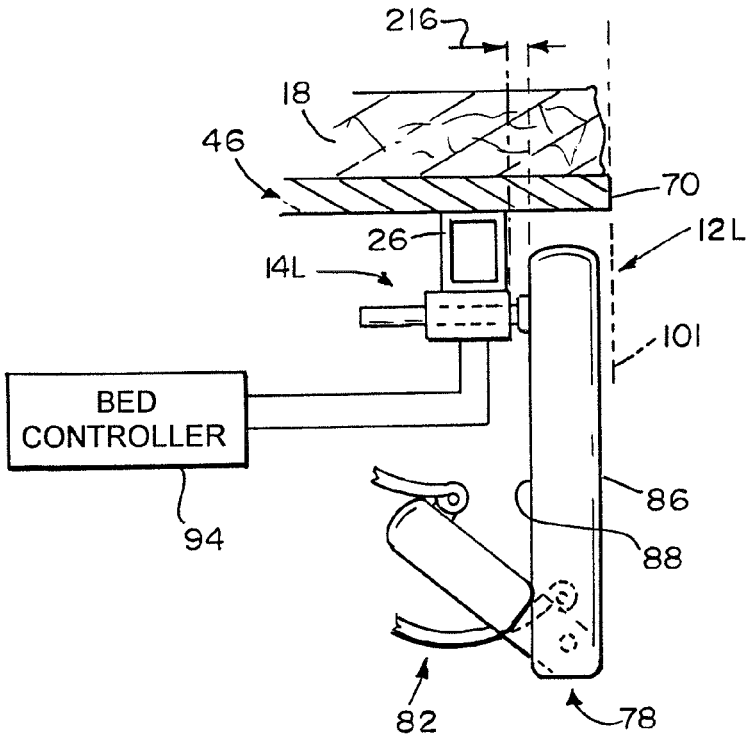
FIG. 7 is an enlarged partial elevational view of another embodiment of a siderail mover in a retracted position causing a siderail assembly to be in a first lowered position.
Figure 8:
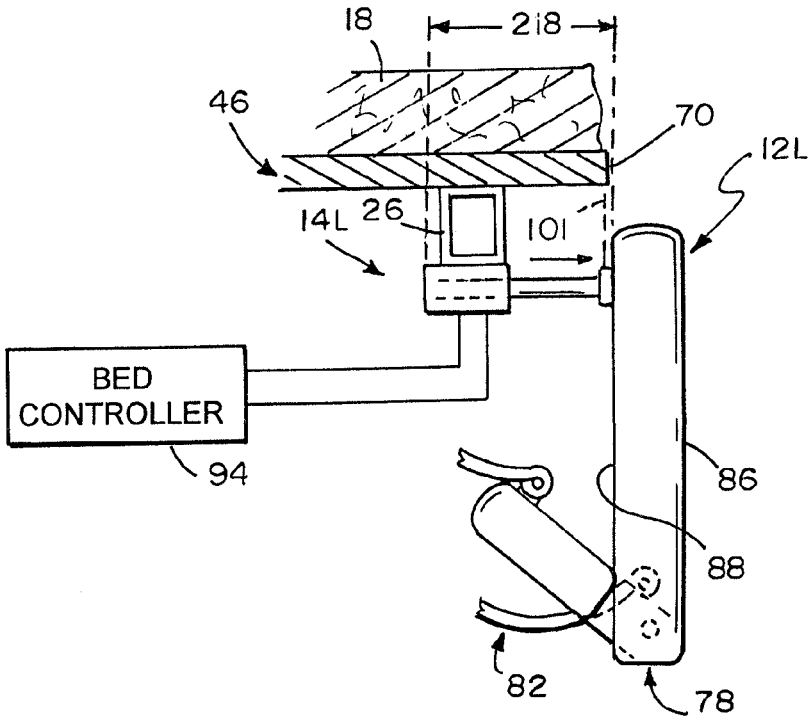
FIG. 8 is a view similar to FIG. 7 with the siderail mover in an extended position causing the siderail assembly to be in a second lowered position.

Another embodiment of a patient-left siderail mover 214L is shown in FIGS. 7 and 8. The siderail movers 14L and 14R are omitted from a hospital bed 210 and replaced with the patient-left siderail mover 214L and the patient-right siderail mover (not shown). The patient-left siderail mover 214L is similar to the patient-left siderail mover, and thus, the following discussion of patient-left siderail mover 214L is equally applicable to the patient-right siderail mover. The patient-left siderail mover 214L is also called the siderail mover 214L herein.

As shown in FIGS. 7 and 8, the siderail mover 214L is movable from a retracted position shown in FIG. 7 to an extended position shown in FIG. 8 to cause the siderail 12L to move from the first lowered position to the second lowered position. When the siderail mover 14L is in the retracted position, the siderail mover 214L has a first length 216 that causes the siderail 12L to remain in the first lowered position as shown in FIG. 7. When the siderail mover 214L is in the extended position, the siderail mover 212L has a second length 218 that causes the siderail 12L to move to the second lowered position as shown in FIG. 8. The first length 216 is less than the second length 218.

The siderail mover 214L is an actuator coupled to the upper frame 26 of the hospital bed 210. The actuator 214L is coupled electrically to the bed controller 94. The bed controller 94 causes the actuator to move from the retracted position of FIG. 7 to the extended position of FIG. 8 in response to movement of the foot section 46 from the substantially horizontal position to the substantially vertical position.

The illustrative hospital beds 10 and 210 are a so-called chair egress bed, in that they are movable between a bed position, as shown in FIG. 1, and a chair-egress position as shown in FIG. 2. However the teachings of this disclosure are applicable to all types of hospital beds, including those that are incapable of achieving a chair-egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Although certain illustrative embodiments have been described in detail above, variations and modifications exist within the scope and spirit of this disclosure as described and as defined in the following claims.

The invention claimed is:

1. A patient support apparatus comprising a frame including a deck movable between a bed position and a chair position, a barrier assembly coupled to the frame and including a barrier movable relative to the deck between a raised position and a first lowered position in which the barrier is positioned beneath the deck and within a perimeter of the deck when the deck is in the bed position; and a barrier mover coupled to the frame and operable automatically in response to movement of the deck from the bed position toward the chair position to contact the barrier and move the barrier from the first lowered position, out from under the deck to a second lowered position in which the barrier is outside the perimeter of the deck and is out of the way of a portion of the deck as it moves toward the chair position.

2. The patient support apparatus of claim 1, wherein the barrier mover comprises an actuator that moves between a retracted position and an extended position.

3. The patient support apparatus of claim 2, wherein the retracted position of the actuator corresponds to the first lowered position of the barrier and the extended position of the actuator corresponds to the second lowered position of the barrier.

4. The patient support apparatus of claim 3, further comprising a controller that electrically controls the movement of the actuator between the retracted and extended positions.

5. The patient support apparatus of claim 1, wherein the portion of the deck comprises a foot section of the deck and wherein the foot section is configured to support lower legs of a patient when the deck is in the bed position.

6. The patient support apparatus of claim 5, wherein the foot section is oriented substantially horizontally when the deck is in the bed position and the foot section is oriented substantially vertically when the deck is in the chair position.

7. The patient support apparatus of claim 6, wherein the foot section changes length due to movement of at least one portion of the foot section relative to another portion of the foot section as the deck moves between the bed position and the chair position.

8. The patient support apparatus of claim 1, wherein the barrier comprises a panel that is oriented substantially vertically when the barrier is in the raised position, the first lowered position, and the second lowered position.

9. The patient support apparatus of claim 1, wherein the barrier comprises a top surface that faces upwardly when the barrier is in the raised position, the first lowered position, and the second lowered position.

10. The patient support apparatus of claim 1, further comprising a user interface coupled to the barrier.

11. The patient support apparatus of claim 1, wherein the chair position comprises at least one of a chair-egress position and a cardiac chair position.

12. The patient support apparatus of claim 1, further comprising a linkage that couples the barrier to the frame.

13. The patient support apparatus of claim 12, wherein the linkage is configured to maintain the barrier in a substantially vertical orientation as the barrier moves between the raised position, the first lowered position, and the second lowered position.

14. The patient support apparatus of claim 1, further comprising a mattress supported by the deck.

15. The patient support apparatus of claim 14, wherein the mattress has a top surface that extends from a head end of the deck to the foot end of the deck in an uninterrupted manner.

16. The patient support apparatus of claim 15, wherein the mattress bends with the deck as the deck moves from the bed position to the chair position.

17. The patient support apparatus of claim 14, wherein the barrier is situated beneath the mattress when the barrier is in the first lowered position and the barrier is out from under the mattress when the barrier is in the second lowered position.

18. The patient support apparatus of claim 1, wherein the frame further comprises a base frame, an upper frame, and an elevation system interconnecting the base frame and upper frame, the deck being coupled to the upper frame.

19. The patient support apparatus of claim 18, wherein the barrier is situated laterally outboard of the base frame when the elevation system supports the upper frame in a low position relative to the base frame.

* * * * *